US010961656B2

(12) United States Patent
Giachetti

(10) Patent No.: US 10,961,656 B2
(45) Date of Patent: Mar. 30, 2021

(54) MACHINE FOR SPREADING FABRIC

(71) Applicant: MORGAN TECNICA S.p.A., Adro (IT)

(72) Inventor: Franco Giachetti, Adro (IT)

(73) Assignee: MORGAN TECNICA S.p.A., Adro (IT)

( * ) Notice: Subject to any disclaimer, the term of this patent is extended or adjusted under 35 U.S.C. 154(b) by 483 days.

(21) Appl. No.: 15/573,386

(22) PCT Filed: May 10, 2016

(86) PCT No.: PCT/IB2016/052657
§ 371 (c)(1),
(2) Date: Nov. 10, 2017

(87) PCT Pub. No.: WO2016/181298
PCT Pub. Date: Nov. 17, 2016

(65) Prior Publication Data

US 2018/0112352 A1 Apr. 26, 2018

(30) Foreign Application Priority Data

May 14, 2015 (IT) ..... MI2015A0675

(51) Int. Cl.
*D06H 7/02* (2006.01)
*B65H 45/103* (2006.01)
(Continued)

(52) U.S. Cl.
CPC ..... *D06H 7/02* (2013.01); *B65H 16/028* (2013.01); *B65H 16/04* (2013.01); *B65H 16/106* (2013.01);
(Continued)

(58) Field of Classification Search
CPC .... B65H 16/00; B65H 16/028; B65H 16/106; B65H 20/00; B65H 20/06; B65H 20/08;
(Continued)

(56) References Cited

U.S. PATENT DOCUMENTS 4,084,467 A * 4/1978 Schwarz ..... B65H 16/028 242/563.2
4,355,794 A * 10/1982 Costigan ..... B65H 45/103 270/30.09
(Continued)

FOREIGN PATENT DOCUMENTS

CN 101446010 A 6/2009
CN 104528451 A 4/2015
(Continued)

OTHER PUBLICATIONS

DE4001740 (C2) Translation; Shiken et al; Device for Spreading Cloth From Roll Onto Table; Published: May 26, 1994; Espacenet (Year: 1994).*
(Continued)

*Primary Examiner* — Michael R Mansen
*Assistant Examiner* — Raveen J Dias
(74) *Attorney, Agent, or Firm* — Merchant & Gould P.C.

(57) ABSTRACT

A machine (1) for spreading fabric on a spreading plane (2) includes a carriage (3) that is movable on the spreading plane, the carriage has an unwinding system (6) for unwinding the fabric; an inclined chute arranged below; a cutting system (11) for cutting the fabric, arranged at a lower end (12) of the chute; and a movement system (35) for moving the unwinding system between a first and a second unwinding operating configuration. In the first configuration, a first end (14) of the unwinding system is vertical to the chute (10) and in the second configuration, the first end (14) is in an advanced position towards the cutting head (13).

17 Claims, 11 Drawing Sheets

(51) Int. Cl.

| | |
|---|---|
| ***B65H 16/10*** | (2006.01) |
| ***B65H 16/02*** | (2006.01) |
| ***B65H 35/06*** | (2006.01) |
| ***B65H 16/04*** | (2006.01) |
| ***B65H 20/06*** | (2006.01) |
| ***B65H 35/00*** | (2006.01) |
| ***B65H 43/00*** | (2006.01) |

(52) U.S. Cl.
CPC ..... *B65H 20/06* (2013.01); *B65H 35/0086* (2013.01); *B65H 35/06* (2013.01); *B65H 43/00* (2013.01); *B65H 45/103* (2013.01); *B65H 2301/51512* (2013.01); *B65H 2404/256* (2013.01); *B65H 2404/692* (2013.01); *B65H 2511/20* (2013.01); *B65H 2511/416* (2013.01); *B65H 2701/174* (2013.01)

(58) Field of Classification Search
CPC ..... B65H 20/36; B65H 20/40; B65H 35/00; B65H 35/008; B65H 35/04; B65H 35/06; B65H 35/0086; B65H 43/00; B65H 43/02; B65H 26/00; B65H 26/04; B65H 26/02; B65H 26/06; B65H 26/063; B65H 45/103; B65H 2404/256; B65H 2404/692; D06H 7/00; D06H 7/02
See application file for complete search history.

(56) References Cited

U.S. PATENT DOCUMENTS

| | | | | | |
|---|---|---|---|---|---|
| 4,392,646 | A * | 7/1983 | Costigan | B65H 45/103 | 270/30.05 |
| 4,477,065 | A * | 10/1984 | Smith | B65H 45/103 | 270/30.12 |
| 4,516,760 | A * | 5/1985 | Stumpf | B65H 45/103 | 239/588 |
| 4,519,595 | A * | 5/1985 | Adachi | B65H 16/106 | 270/30.11 |
| 4,527,346 | A * | 7/1985 | Schwartzott | A41H 43/005 | 112/DIG. 2 |
| 4,573,618 | A * | 3/1986 | Kikuchi | B65H 45/103 | 226/42 |
| 4,575,066 | A * | 3/1986 | Nasu | B65H 45/103 | 270/30.11 |
| 4,595,328 | A * | 6/1986 | Seitz | B65H 16/021 | 198/339.1 |
| 5,699,980 | A | 12/1997 | Balsells Ventura | | |
| 5,704,603 | A * | 1/1998 | Nalecz | B65H 23/042 | 242/420.3 |
| 2017/0152120 | A1 * | 6/2017 | Montoya | B65H 19/126 | |

FOREIGN PATENT DOCUMENTS

| | | |
|---|---|---|
| DE | 40 01 740 A1 | 7/1991 |
| JP | S56-154952 U | 11/1981 |
| JP | H04-28667 A | 1/1992 |

OTHER PUBLICATIONS

International Search Report and Written Opinion of the International Searching Authority for corresponding International Patent Application No. PCT/IB2016/052657 dated Aug. 5, 2016, 8 pages.
Examination Report for Indian Patent Application No. 201717041800, dated Aug. 17, 2020.

* cited by examiner

MACHINE FOR SPREADING FABRIC

This application is a National Stage Application of PCT/IB2016/052657, filed 10 May 2016, which claims benefit of Serial No. MI2015A000675, filed 14 May 2015 in Italy and which applications are incorporated herein by reference. To the extent appropriate, a claim of priority is made to each of the above disclosed applications.

BACKGROUND OF THE INVENTION

The object of the present invention is a machine for spreading fabric that is, a machine that is capable of laying out a layer or a number of overlapping layers of fabric on a plane surface, unwinding it from a roll of fabric or from folded fabric.

There are prior-art machines for spreading fabric that comprise a spreading plane and a carriage that is movable with rectilinear forward-backward motion over the spreading plane. A system for unwinding the fabric is mounted on the carriage and comprises a pair of conveyor belts arranged adjacently in a "V" shape so as to define an area for receiving the roll of fabric to be unwound, with the axis thereof arranged horizontally. An inclined chute is also mounted on the carriage and a cutting system for cutting the fabric is mounted in the proximity of the lower end of the chute.

In use, the simultaneous rotation of the conveyor belts transmits rotational motion to the roll of fabric about its own axis, which results in the unwinding of the fabric from the roll. The strip of unwound fabric is conveyed by the conveyor belt arranged downstream (with respect to the direction of advancement of the unwound fabric) to the free end, from which the fabric, continuing to move, drops downwards until it rests on the inclined chute that guides the strip of fabric towards the cutting system and from there to the spreading plane.

The coordinated movement of the conveyor belts and of the carriage gradually spreads the strip of unwound fabric on the spreading plane. Once the desired length of fabric has been laid out, the cutting system cuts the fabric and the spreading cycle can thus resume.

The Applicant has observed that this spreading technique is not optimal for some fabrics, including for example very thin and/or lightweight knit fabrics, in that sliding on the chute and/or being drawn over a substantial portion of the belt leads to the formation of creases in the fabric spread out on the spreading plane, resulting in the need for an operator to intervene so as to remove them manually.

There is also an alternative prior-art technique in which the unwound fabric drops vertically from an unwinding system until it engages the cutting system, without any chute on which the fabric can slide.

However, the Applicant has observed that this spreading technique leads to a lower spreading speed, even when fabrics of substantial weight are spread. This is because the vertical drop of the fabric creates a "sail" of sorts, which tends to belly owing to the coming and going motion of the carriage, and this effect increases as the speed of deposition increases, said speed thus being subject to a limit.

SUMMARY OF THE INVENTION

U.S. Pat. No. 5,699,980 discloses a machine for spreading fabric.

The Applicant has addressed the issue of developing a machine for spreading fabric that can resolve one of more of the drawbacks discussed above.

In particular, the Applicant has addressed the issue of developing a machine for spreading fabric that is capable of versatilely spreading both lightweight fabrics, using the vertical drop technique, and more substantial fabrics, using the chute drop technique, thereby ensuring that the respective speeds of deposition are optimal, without mutually influencing or limiting each other, and further ensuring ease and/or rapidity in changing from one spreading technique to the other.

This problem, as well as others which are described herein below, is resolved by a machine for spreading fabric in accordance with the present invention in various embodiments thereof, as specified below and according to that which is claimed in the appended claims, and possibly in combination with the following embodiments.

In one aspect, the invention concerns a machine for spreading fabric on a spreading plane, comprising a carriage that is movable on the spreading plane with rectilinear forward-backward motion along a spreading direction (parallel to the spreading plane), the carriage comprising:

- an unwinding system comprising at least a first member adapted to set a roll of fabric into rotation so as to unwind the fabric;
- an inclined chute arranged at a lower level of at least one portion of the first member,
- a cutting system for cutting the fabric, arranged at a lower end of the chute and comprising a cutting head.

The unwinding system has a first end and a second end proximal to and distal from said cutting system, respectively, said first end being adapted, in use, to drop the unwound fabric downwards.

Advantageously, said carriage comprises a movement system adapted to move said unwinding system between at least a first and a second unwinding operating configuration.

Preferably, in said first configuration, said first end of the unwinding system is vertical to said chute and in said second configuration, said first end is located in a position closer to the vertical to said cutting head, with respect to the first configuration.

The terms "horizontal", "vertical", "lower", "upper", "high", "low" and other similar terms refer to a typical installation of said machine with the spreading plane arranged on the horizontal plane with respect to the direction of gravity (which defines the vertical direction). However, the present invention encompasses the case of installations with a spreading plane that is not horizontal, in which case the above-mentioned terms shall refer to the actual spreading plane.

Moreover, the terms "upstream" and "downstream" are understood as referring to the local direction of advancement of the strip of unwound fabric.

According to the Applicant, the presence of a movement system for moving the fabric unwinding system between a first unwinding operating configuration, in which the end for dropping the fabric is located on the vertical of the chute, and a second unwinding operating configuration, in which the end for dropping the fabric is closer to the vertical to the cutting head (substantially avoiding the chute), makes it possible to make the machine versatilely suited to both of the spreading techniques described above, with the chute drop and the substantially vertical drop, and it also enables simple and rapid switching from one to the other technique.

In use, the axis of the roll of fabric is typically arranged horizontally and perpendicular to the spreading direction.

Preferably, a distance, taken on a chute plane of said chute along a direction of advancement of the fabric, between two respective points extending vertically of said first end on said chute plane in said first and said second configuration, respectively, is greater than or equal to half (more preferably two-thirds) of a total length of said chute along said direction of advancement.

Preferably, in said first configuration, said first end of the unwinding system is vertical to a point of said chute having a distance, taken along a chute plane of said chute, from an upper end of said chute, less than or equal to half (preferably less than or equal to a third) of a total length of said chute along a direction of advancement of the fabric along said chute plane. Advantageously, in this manner, the fabric covers a substantial portion of the chute at all times, thus enabling it to follow the foreword-backward movement of the carriage owing to the weight of the fabric on the chute (the chute also functioning as a shield from the current of air that is created as the carriage moves).

Preferably, in said second configuration, said first end is located on the vertical of a point in the vicinity of the cutting head and/or interposed between a lower end of said chute and said cutting head; more preferably, it is located on the vertical of said cutting system, even more preferably on the vertical of an auxiliary chute of said cutting system and arranged in the vicinity of said cutting head upstream of the latter with respect to a direction of advancement of the fabric. Advantageously, in this manner, the fabric completely avoids the chute and a vertical drop is created reaching almost as far as the cutting head.

Said unwinding system typically has a conveying surface having a (reversible) direction of advancement for setting the roll of fabric into rotation and/or for advancing the unwound fabric along said direction of advancement.

Said conveying surface typically has a first and a second end proximal to or coincident with the first and the second end of the unwinding system, respectively.

Said first member is preferably a conveyor belt adapted to support said roll of fabric and comprising a pair of motorized rollers (where at least one of the two rollers is motorized) and a mat arranged to wind the rollers so as to define said conveying surface. This structure has been found to be both simple and effective.

The winding system preferably comprises a second rotating member (preferably a roller) arranged in the vicinity of a first end of the first member, proximal to the first end of the unwinding system, and at least partially (preferably entirely) arranged in an upper half-space with respect to the conveying surface of the first member, more preferably separated from said first member. The axis of rotation of the second member is typically parallel to the axis of rotation of the first member. Preferably, said second member is motorized, more preferably in an independent manner with respect to said first member. In this manner, the second member can cooperate with the first member so as to support and/or set the roll of fabric into rotation. The second member can also cooperate with the first member for reversed unwinding of the fabric, in which the unwound fabric drops from the unwinding system tangentially to the second member, unlike what happens in the normal unwinding process, in which the unwound fabric drops from the unwinding system at the first end of the first member.

Preferably, in said first and/or second configuration, said conveying surface is downhill from the second end to the first end of the conveying surface. Preferably, the conveying surface forms an acute angle, with the horizontal plane, that is less than or equal to 60°, more preferably less than or equal to 40°, and/or greater than or equal to 10°, and more preferably greater than or equal to 15°. Advantageously, in this manner, given that the roll of fabric is retained by the second member at the first end of the unwinding system, the unwound fabric is conveyed by the first member only for a short section or it does not touch the first member at all (as in the case of the reversed unwinding process), although it is guided by the chute towards the cutting system.

Preferably, the movement system is adapted to give to said unwinding system a first translational forward-backward motion with respect to a base of the carriage along a (preferably rectilinear) trajectory having at least one component along said spreading direction (preferably parallel to said spreading direction) and a second oscillatory motion with respect to said base about an oscillation axis that is horizontal and (substantially) perpendicular to said spreading direction. In this manner, considerable versatility is obtained as regards the positioning of the unwinding system, also enabling changes in the orientation of the conveying surface.

Preferably, the first and/or second motions are continuous (as opposed to discrete). In this manner, the unwinding system can assume a continuum of positions.

The movement system preferably comprises a movable support mounted on a base of the carriage so as to be able to move along said trajectory of the first translational motion, wherein said unwinding system is mounted on said movable support so as to oscillate according to said second oscillatory motion. Preferably, the members of the unwinding system are rotatably mounted on a rigid structure, which is mounted on said movable support so as to oscillate according to said second oscillatory motion. In this manner, effective movement of the unwinding system between the various configurations of the present invention is obtained. The unwinding system preferably comprises a first motor for powering in rotation said first member and a second motor for powering in rotation said second member. Said oscillation axis preferably extends along a powered rotation shaft of the first member. Advantageously, in this manner the first motor can be mounted on said movable support. Preferably, the first motor is rigidly mounted on said movable support and the second motor is rigidly mounted on said rigid structure.

The movement system preferably comprises a third motor and first connection members between the third motor and said movable support, for giving said first translational motion to the movable support, and thus to the unwinding system. The movement system preferably comprises a first actuation system (for example comprising a pair of opposite pistons) that is operatively interposed between said movable support and said rigid structure, for giving said second oscillatory motion to the unwinding system.

The carriage typically comprises a base equipped with motorized wheels (powered by a fourth motor mounted on the base) for forward-backward movement of the carriage on the spreading plane. The carriage typically further comprises a frame mounted on the base and a second actuation system that is operatively interposed between said base and said frame, for giving to the frame translational forward-backward motion with respect to the base along an additional direction that is typically parallel to the spreading plane and perpendicular to the forward-backward direction of the carriage. Said movable support is preferably mounted on said frame and said third motor and said first connection members are mounted on said frame.

Preferably, the movement system is adapted to move said unwinding system in a loading and/or unloading configuration, in which said first end of the unwinding system is more distal to the cutting head with respect to the first configuration, and, more preferably, the conveying surface of the unwinding system is substantially horizontal (that is, it forms an angle—a positive or negative angle—with the horizontal plane, whose absolute value is less than or equal to 10°) and, even more preferably, the second end of the unwinding system is located at one end of the carriage opposite said cutting system. More preferably, said movable support is in a position of said trajectory of the first translational motion that is completely retracted with respect to said cutting system.

The unwinding system preferably comprises a third rotating member (preferably a roller) arranged in the vicinity of a second end of the first member proximal to said second end of the unwinding system, and configured to assume at the least a first position in which it is at least partially (preferably entirely) arranged in an upper half-space with respect to the conveying surface. In this manner, the third member cooperates with the first member so as to support and/or move the roll of fabric, for example in the loading/unloading configuration and/or in the third configuration described below. The axis of rotation of the third member is typically parallel to the axis of rotation of the first and/or second member.

The movement system is preferably adapted to move said unwinding system in a third configuration, in which said conveying surface is uphill from the second end to the first end of the conveying surface, and in which said first end of the unwinding system is vertical to said chute (preferably in a position similar to the position assumed in the first configuration). Preferably, the conveying surface forms an acute angle with the horizontal plane that is less than or equal to 60°, more preferably less than or equal to 40°, and/or greater than or equal to 10°, and more preferably greater than or equal to 15°. Advantageously, in this manner the unwound fabric is conveyed along a substantial section of the conveying surface, as takes place in the conventional unwinding technique.

In one embodiment, the third member is fixed in said first position.

In an alternative embodiment, the third member is articulated with respect to the first member so as to assume a plurality of positions in relation to the latter. The movement system is preferably adapted to move said third member between said first position and at least a second position in which it is substantially aligned with said conveying surface. Advantageously, in this manner the third member can be arranged so as to facilitate the loading and/or unloading of the roll of fabric.

Said third member is preferably motorized, typically in a manner that is synchronized with said first member.

Preferably, the cutting system is translatable with respect to the base (e.g. by means of a fifth motor mounted on the base) along a direction having at least one vertical component (more preferably along a vertical direction). In this manner, the position of the cutting system is adjusted as a function of the height of the stack of fabric strips already present on the spreading plane.

The chute preferably comprises at least a first and a second portion that can reciprocally slide in a telescopic manner along a chute plane. The first portion of the chute is preferably fixed to the base and the second portion of the chute is fixed to the cutting system. Advantageously, in this manner the length of the chute plane adapts to the inclination of the chute plane.

In one embodiment, said movement system is adapted to configure said chute as a function of the configuration of said unwinding system. Preferably, an upper end of said chute is constrained to said second end of the unwinding system with a rotational degree of freedom. In this manner, the inclination of the chute is determined as a function of the configuration of the unwinding system.

The cutting system preferably comprises an auxiliary inclined chute arranged in the proximity of the cutting head and upstream of it, surmounted on top by a retaining bar that is movable between a position separated from the auxiliary chute (so as to enable the fabric to slide) and a contact position pressed against the auxiliary chute (so as to retain the strip of fabric during the cutting process).

The carriage (typically mounted on the base) preferably comprises a screen arranged below at least one portion of the first member and at and above a lower end of said chute, proximal to the cutting system. The screen is preferably made of a rigid material, more preferably of metal or plastic. The screen preferably has a substantially vertical extension, that is, with the vertical it forms an angle less than or equal to 10°. Advantageously, in this manner the screen protects the strip of fabric, which in the vertical drop technique drops in the proximity of the screen, from the current of air (created by the movement of the carriage).

The screen preferably comprises at least a first and a second portion that can reciprocally slide in a telescopic manner along a plane of extension of the screen. The first portion of the screen is preferably fixed to the base and the second portion of the screen is fixed to the cutting system. Advantageously, in this manner the overall vertical extension of the screen adapts to the height of the cutting system from the chute plane.

The cutting system preferably comprises a detection system for detecting the tension of the unwound fabric arranged downstream of the cutting head, with respect to the direction of advancement of the fabric, and more preferably, arranged below the cutting head. Advantageously, in this manner the detection system for detecting the tension can operate for any configuration of the unwinding system.

The cutting system preferably comprises a detection system for detecting the position of the fabric along the above-mentioned further direction parallel to the spreading plane and perpendicular to the forward-backward direction of the carriage, this detection system (e.g. a retro-reflective photocell sensor) being active on a point arranged in the proximity of the cutting head upstream of it, and more preferably at said auxiliary chute and/or in the proximity of the lower end of the chute. Advantageously, in this manner the position detection system can operate for any configuration of the unwinding system (vertical drop technique and chute drop).

The machine preferably comprises an electronic command and control unit (typically mounted on said carriage, particularly on said base) that is operatively connected with said movement system and configured and programmed to control said movement system in order to selectively configure the unwinding system in one of said first and second configurations and preferably in said third configuration and/or said loading and/or unloading configuration. In this manner, the operator can simply, rapidly and automatically select and activate one of the pre-set configurations.

BRIEF DESCRIPTION OF THE DRAWINGS

Further characteristics and advantages of the present invention will become more apparent from the indicative and thus non-limiting description of several preferred, but not exclusive, embodiments of a machine for spreading fabric in accordance with the present invention. This description refers to the attached drawings, of which.

DETAILED DESCRIPTION OF THE PREFERRED EMBODIMENTS

Figure 1:
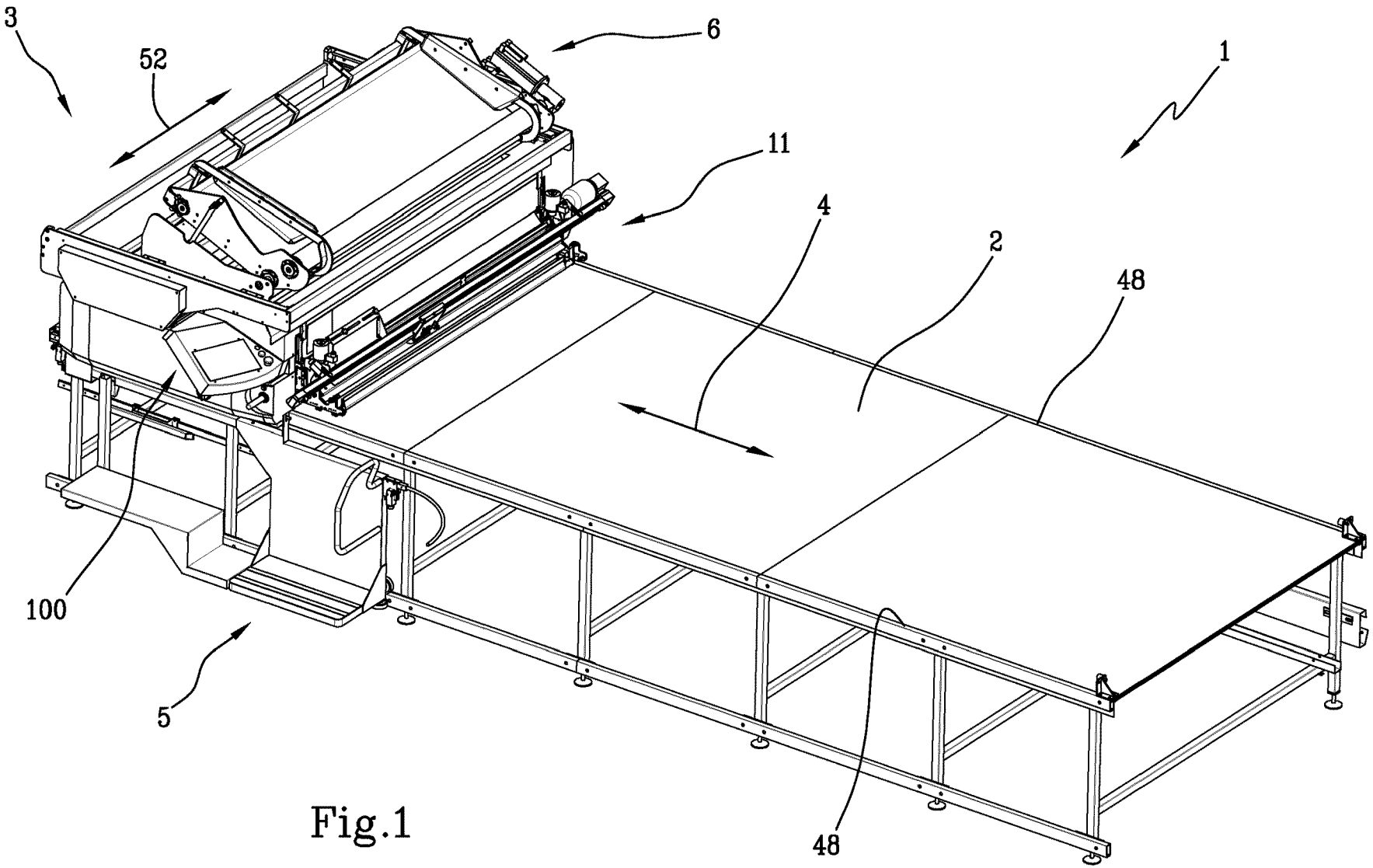
FIG. 1 is a perspective view of a first embodiment of a machine for spreading fabric according to the present invention.
Figure 2:
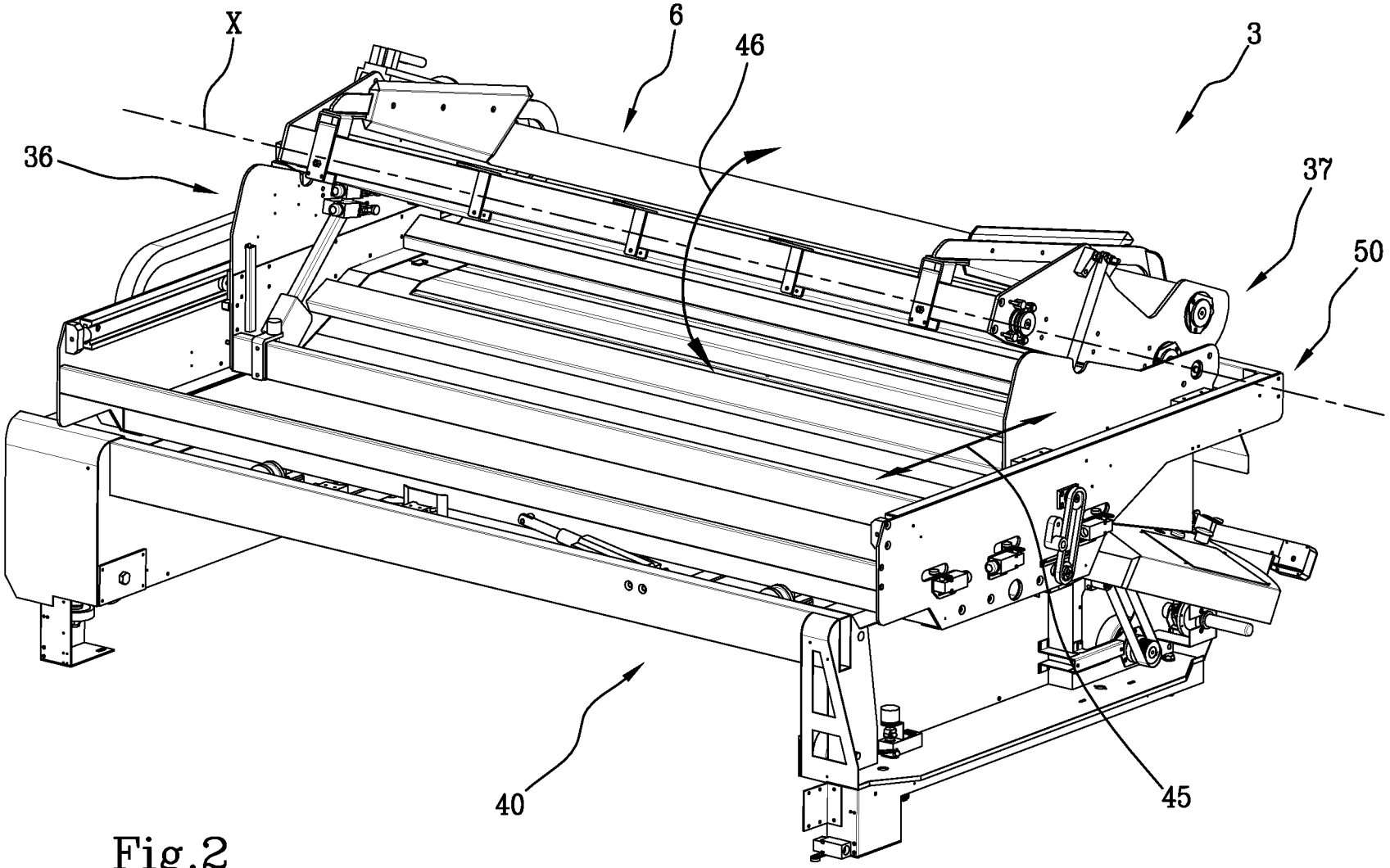
FIGS. 2 and 3 are two partial perspective views, from opposite sides of the carriage of the machine appearing in FIG. 1, with several parts removed.
Figure 3:
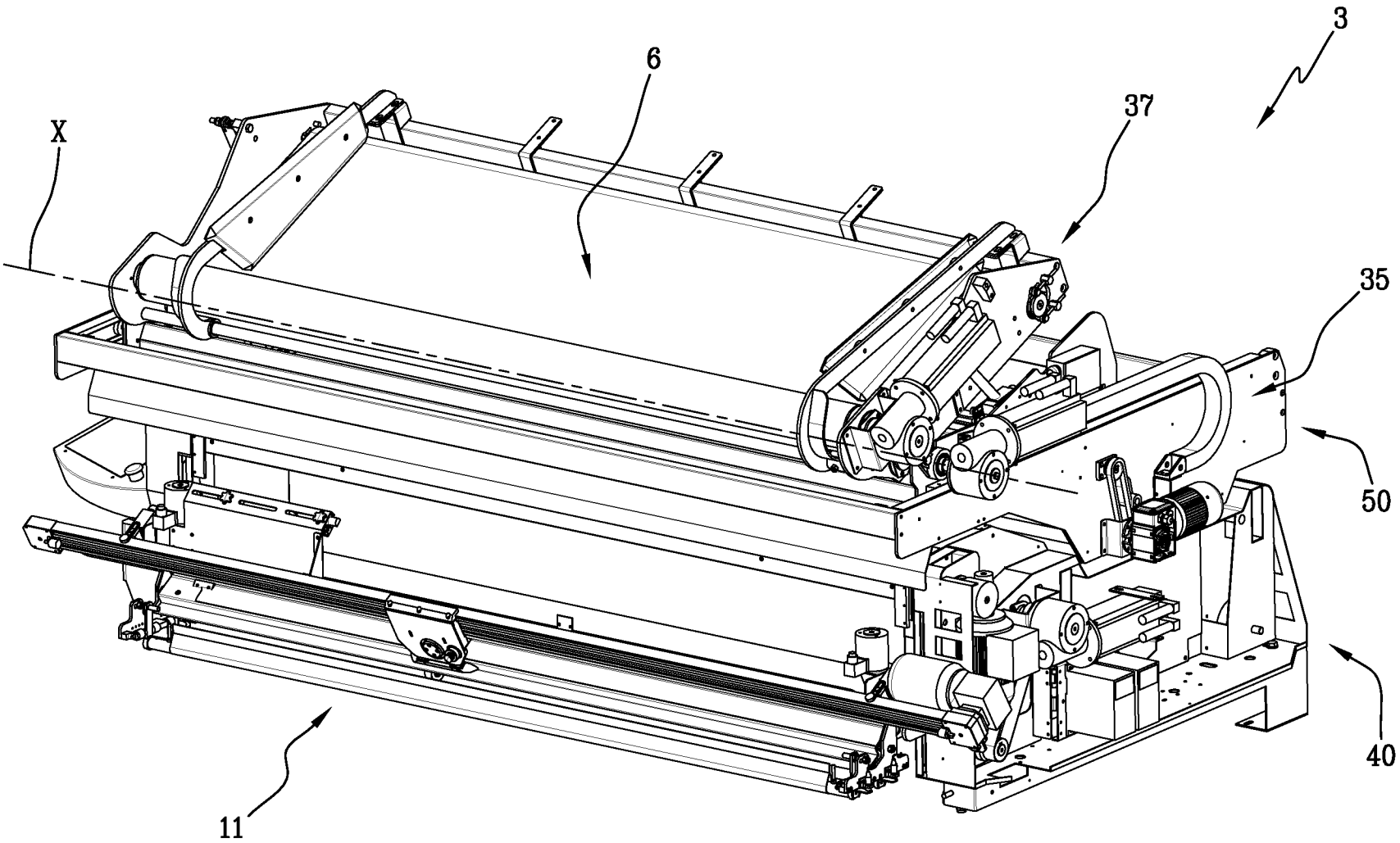
Figure 4:
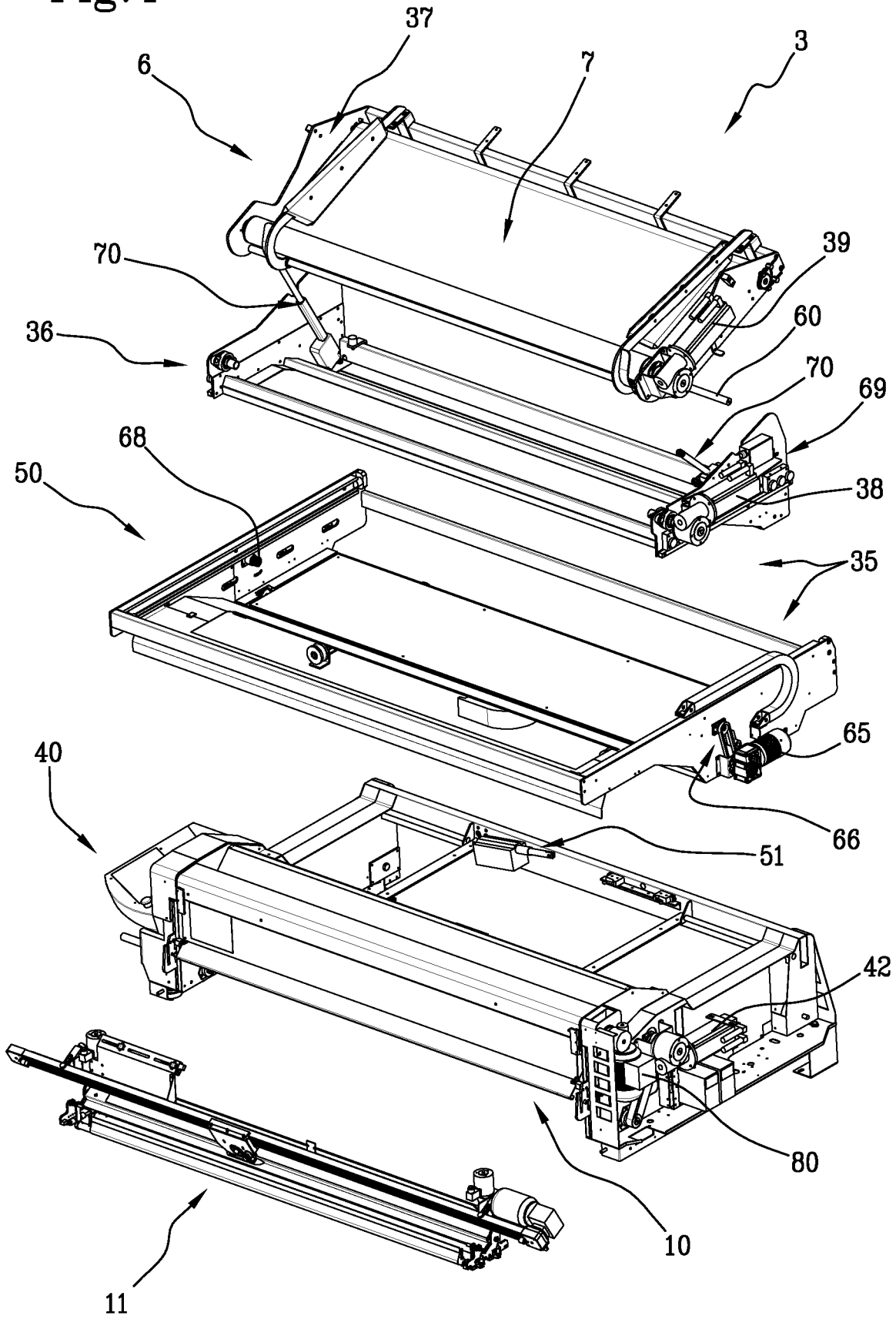
FIG. 4 is a partial perspective and partially exploded view of the carriage of the machine appearing in FIG. 1.
Figure 5:
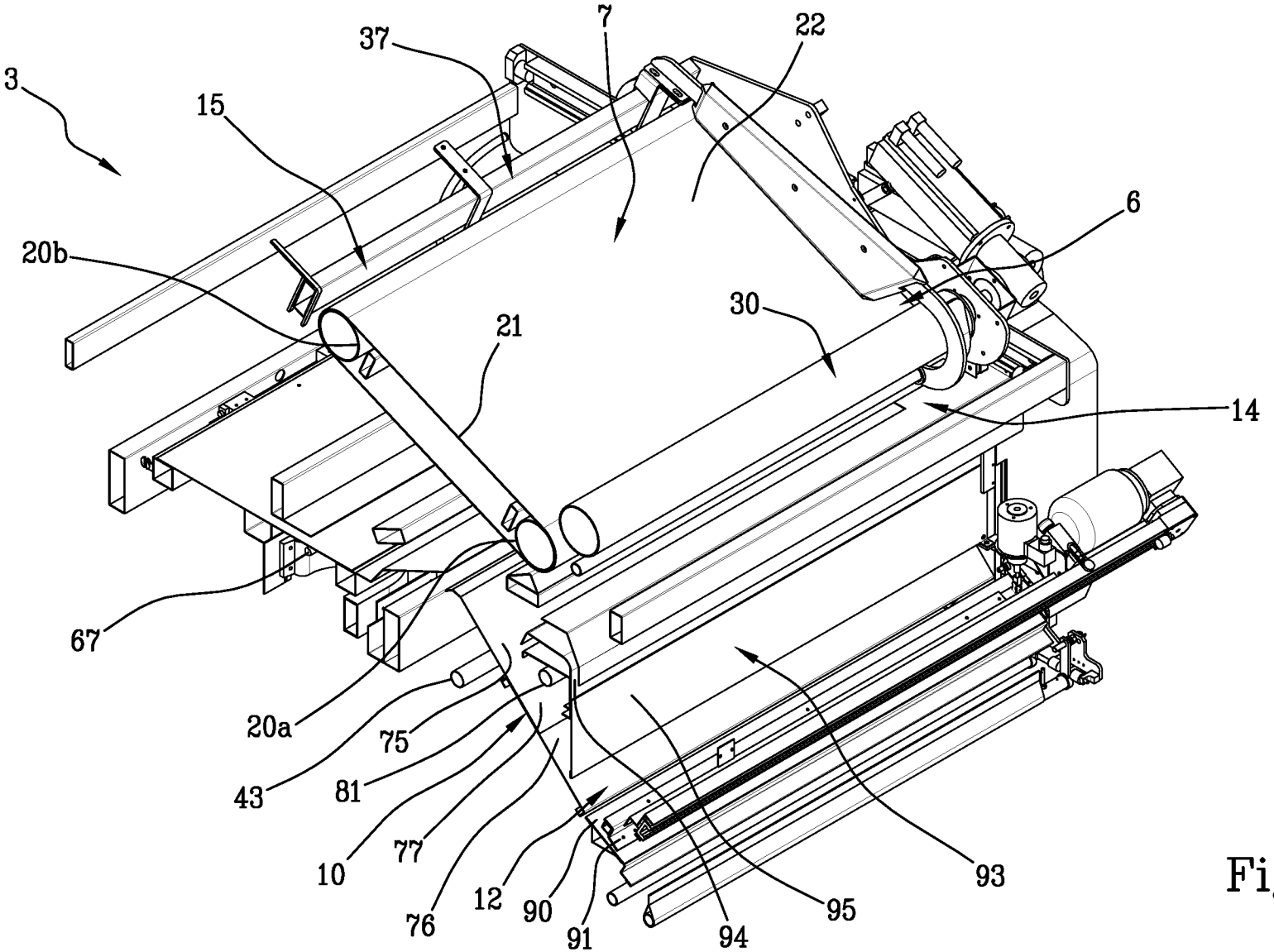
FIG. 5 is a partial perspective section of the carriage appearing in FIG. 1.

A machine 1 for spreading fabric on a spreading plane 2 is shown by way of example in FIG. 1.

The machine comprises a carriage 3 that is movable with rectilinear forward-backward motion along a spreading direction 4 parallel to the spreading plane.

The carriage typically comprises a footboard 5 (omitted in FIGS. 2-6) solidly constrained thereto for supporting an operator.

The carriage comprises an unwinding system 6 comprising a first rotating member 7 for setting a roll of fabric 8 into rotation so as to unwind a strip of fabric 9 (the fabric is schematically shown only in FIGS. 7-11).

The carriage comprises an inclined chute 10 arranged at a lower level of at least one portion of the first member.

The carriage comprises a cutting system 11 for cutting the fabric, arranged at a lower end 12 of the chute, downstream of the latter, and comprising a cutting head 13. The cutting head and the movement system thereof for moving it along a direction transverse to the spreading direction 4 (as indicated by the arrows 13*a*) shall not be described in detail as, for example, those already known to the person skilled in the art can be used.

The end proximal to and the end distal from said cutting system are conventionally defined as the first 14 and the second end 15 of the unwinding system, respectively. In use with a normal unwinding procedure, the first end 14 is typically the end from which the unwound fabric drops downwards and it typically coincides with a first end of the first member.

The first member is preferably a conveyor belt (as shown by way of example in the figures) comprising a pair of rollers 20*a*, 20*b* and a mat 21 arranged to wind the rollers so as to define a conveying surface 22 of the unwinding system.

The present invention also encompasses other alternative embodiments of the first member, for example wherein the conveyor belt is substituted by a set of rollers or even by only one roller of sufficient diameter, or wherein the mat is substituted by one or more belts.

The ends proximal to, typically coincident with, the first 14 and the second end 15 of the unwinding system are conventionally defined as the first and the second end of the conveying surface 22 (or of the first member 7), respectively The unwinding system preferably comprises a second rotating member 30 (preferably a roller, as shown in the figures) arranged in the vicinity of the first end 14 of the first member 7, and arranged entirely in the upper half-space with respect to the conveying surface 22 and separated from the first member so as to realize a slot for passage of the strip of unwound fabric in the case of the normal unwinding process.

The carriage comprises a movement system 35 adapted to move the unwinding system 6.

The carriage preferably comprises a base 40 equipped with wheels 41, two of which are motorized in synchrony for forward-backward movement of the carriage on the spreading plane. The wheels 41 typically travel along the longitudinal edges 48 of the spreading plane 2. The motorization system for the wheels 41 is mounted on the base and comprises a fourth motor 42 and a system of belts and pulleys and a rotation countershaft 43, so as to set a pair of wheels into synchronized rotation. The motorization system for the wheels 41 is described briefly as it is already known to the person skilled in the art.

The carriage further comprises a frame 50 mounted on the base and an actuation system 51 (which is a linear actuator in the example shown in the figures) interposed between the base and the frame so as to give forward-backward translational motion to the frame with respect to the base along a direction 52 parallel to the spreading plane and perpendicular to the spreading direction 4. The translational motion of the frame 50 enables adjustment of the position of the strip of unwound fabric along the direction 52.

The movement system 35 preferably comprises a movable support 36 mounted on the frame 50 so as to be able to move with respect to the base (with respect to the frame 50) along a first translational motion having a trajectory parallel to the spreading direction 4. Preferably, the first 7 and/or second member 30 (and possibly the third member as in the embodiment appearing in FIG. 11) of the unwinding system 6 are rotatably mounted on a rigid structure 37, which is mounted on the movable support 36 so as to oscillate with respect to the base (with respect to the frame 50) according to a second oscillatory motion about an oscillation axis X that is horizontal and perpendicular to the spreading direction 4.

The unwinding system 35 preferably comprises a first motor 38 for powering in rotation the first member and a second motor 39 for powering in rotation the second member. The oscillation axis X preferably extends along a rotation shaft 60 of the first member powered by the first motor, the first motor is rigidly mounted on the movable support and the second motor is rigidly mounted on the rigid structure.

The movement system 35 preferably comprises a third motor 65 and first connection members 66 between the third motor and the movable support 38, for giving the first translational motion to the movable support, and thus to the unwinding system 6. The third motor 65 is preferably rigidly mounted on the frame 50. In the example shown in FIG. 4, the first connection members 66 comprise a system of belts and pulleys and a rotation countershaft 67, all mounted on the frame 50, so as to set into rotation a pair of opposite toothed wheels 68, which mesh with respective opposite racks on the movable support 36. Optionally, a system of guides on the frame 50 and rollers 69 mounted on the movable support 36 guide the movable support during the first translational motion.

Figure 6:
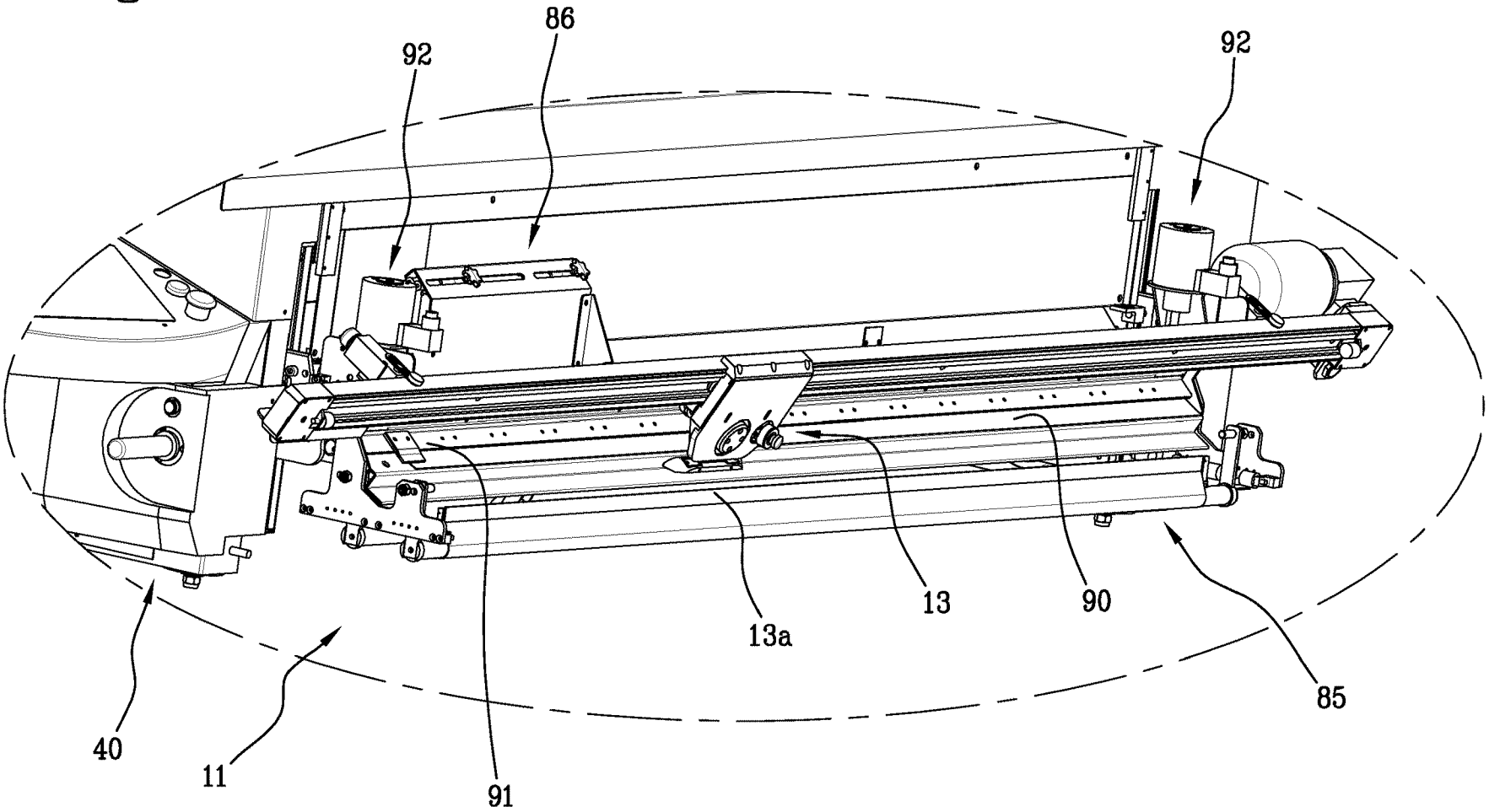
FIG. 6 shows a detail of the carriage of the machine appearing in FIG. 1.

The movement system 35 preferably comprises a first actuation system 70 (e.g. comprising a pair of linear actuators that are opposite to each other as can be seen in FIG. 6) and operatively interposed between the movable support and the rigid structure, for giving the second oscillatory motion to the unwinding system.

The cutting system is preferably vertically translatable with respect to the base (e.g. by means of a fifth motor 80, a rotation countershaft 81, a system of chains and pulleys and a system of guides and rollers mounted on the base, only partially shown in the figures).

The cutting system preferably comprises an auxiliary inclined chute 90 arranged in the proximity of the cutting head and upstream of it, surmounted on top by a retaining bar 91 that is vertically movable (e.g. by means of a pair of rods actuated by electromagnets 92) between a position raised with respect to the auxiliary chute (so as to enable the fabric to slide) and a contact position pressed against the auxiliary chute (so as to retain the strip of fabric during the cutting process).

The cutting system preferably comprises a detection system 86 for detecting the position of the fabric along the above-mentioned direction 52, for example comprising two photocell sensors (one for each end of the fabric position acceptance range), with a retroreflector applied on the auxiliary chute and/or in the proximity of the lower end 12 of the chute.

The cutting system 11 preferably comprises a detection system 85 for detecting the tension of the unwound fabric arranged downstream of the cutting head and below the cutting head.

The tension detection system for example (as shown in the figures) comprises a pair of dancing rollers arranged upstream and downstream of the point where the fabric drops from the cutting head, so as to enable detection of the tension during the process of spreading the fabric forwards and backwards.

The chute preferably comprises at least a first 75 and a second portion 76 that can reciprocally slide in a telescopic manner along a chute plane 77. The first portion of the chute is preferably rotatably fixed to the base and the second portion is fixed to the cutting system.

The carriage (typically mounted on the base) preferably comprises a vertical screen 93 arranged below at least one portion of the first member 7 and at and above the lower end 12 of the chute, proximal to the cutting system. The screen preferably comprises at least a first 94 and a second portion 95 that can reciprocally slide in a telescopic manner along a plane of extension of the screen. The first portion of the screen is preferably fixed to the base and the second portion of the screen is fixed to the cutting system.

Figure 10:
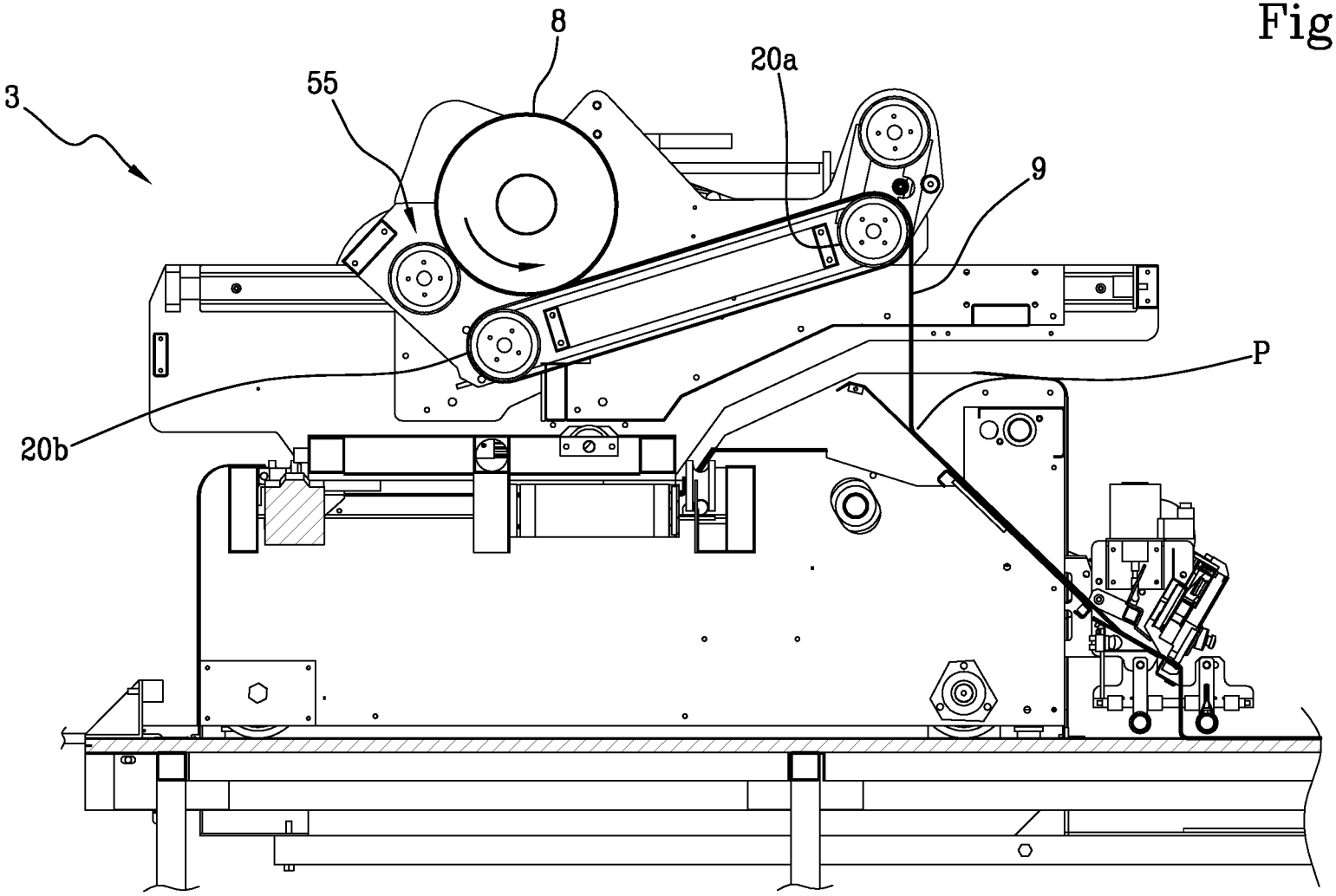
FIGS. 10 and 11 are partially-sectioned schematic views of some possible configurations of the machine in accordance with a second embodiment of the present invention.
Figure 11:
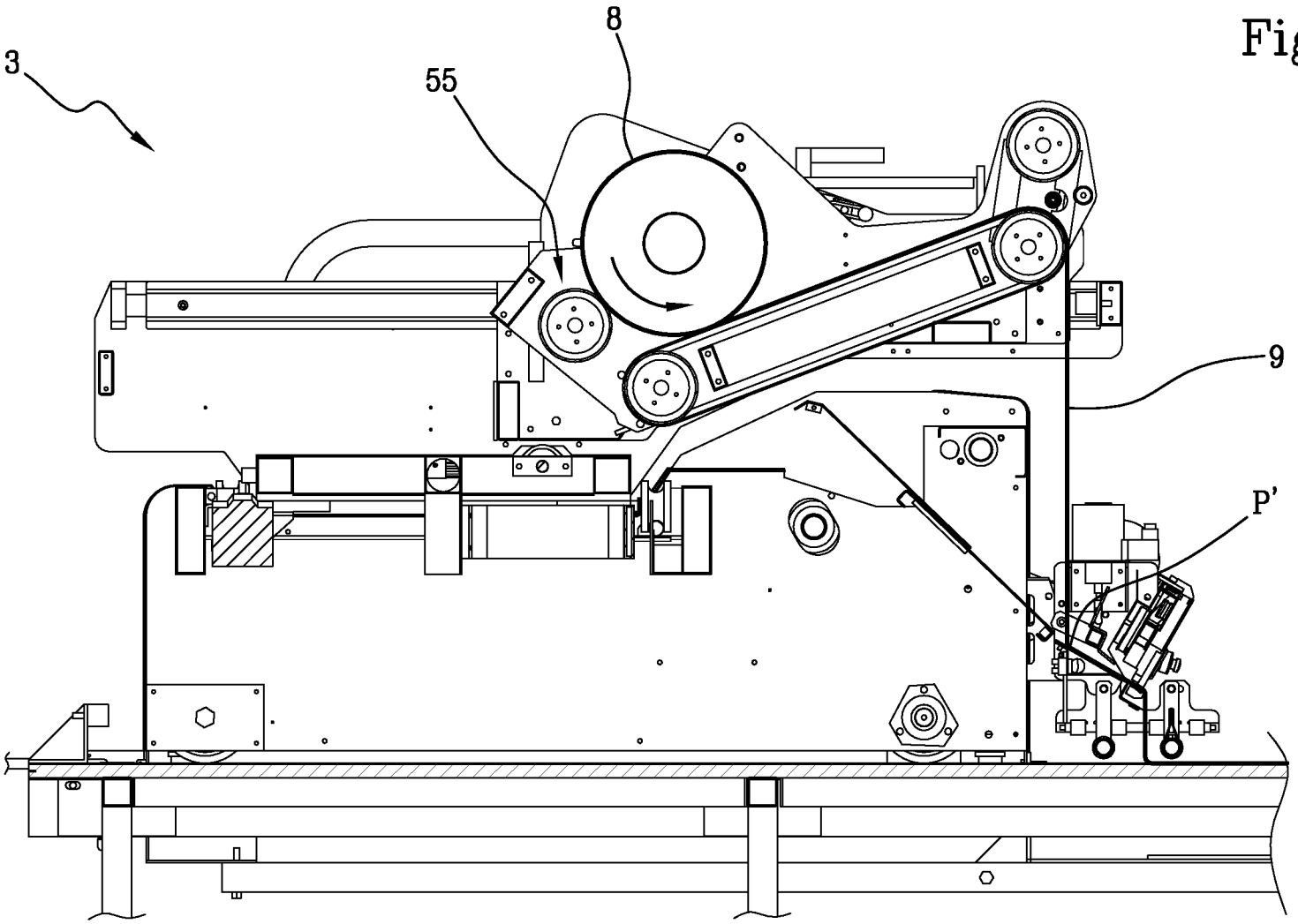

In one embodiment, schematically shown in FIGS. 10 and 11 by way of example, the unwinding system further comprises a third rotating member 55 (preferably a roller) arranged in the vicinity of a second end of the first member, proximal to the second end 15 of the unwinding system. The third rotating member 55 is preferably motorized in a manner that is synchronized with the first member (e.g. by means of a transmission belt that takes rotational motion from the roller 20*b*), but it can also be idle or independently motorized.

In the example shown in FIGS. 10 and 11, the third member 55 is in a fixed position with respect to the first member 7, and it is arranged entirely in the upper half-space with respect to the conveying surface.

In an alternative embodiment, which is not shown, the third member is articulated with respect to the first member so as to assume a plurality of positions in relation to the latter, while maintaining the axis of rotation parallel to the axis of rotation of the first and second member (e.g. by means of an articulated arm having its fulcrum on the axis of rotation of the roller 20*b*, so as to maintain a fixed distance from the roller 20*b*). In this case, the movement system can preferably move the third member between the above-mentioned position and at least a second position in which it proves to be substantially aligned with the conveying surface, for example to facilitate the loading and/or unloading of the roll of fabric.

The machine preferably comprises an electronic command and control unit 100 (typically mounted on the base) that is operatively connected with the movement system and configured and programmed to control the movement system in order to selectively configure the unwinding system 6 in various operating configurations for unwinding the fabric, as described further herein below.

The command and control unit is preferably also operatively connected to all the remaining active means of the machine (motors and actuators) and to all the detection devices and/or sensors, for the purpose of controlling and commanding the spreading procedures.

Figure 7:
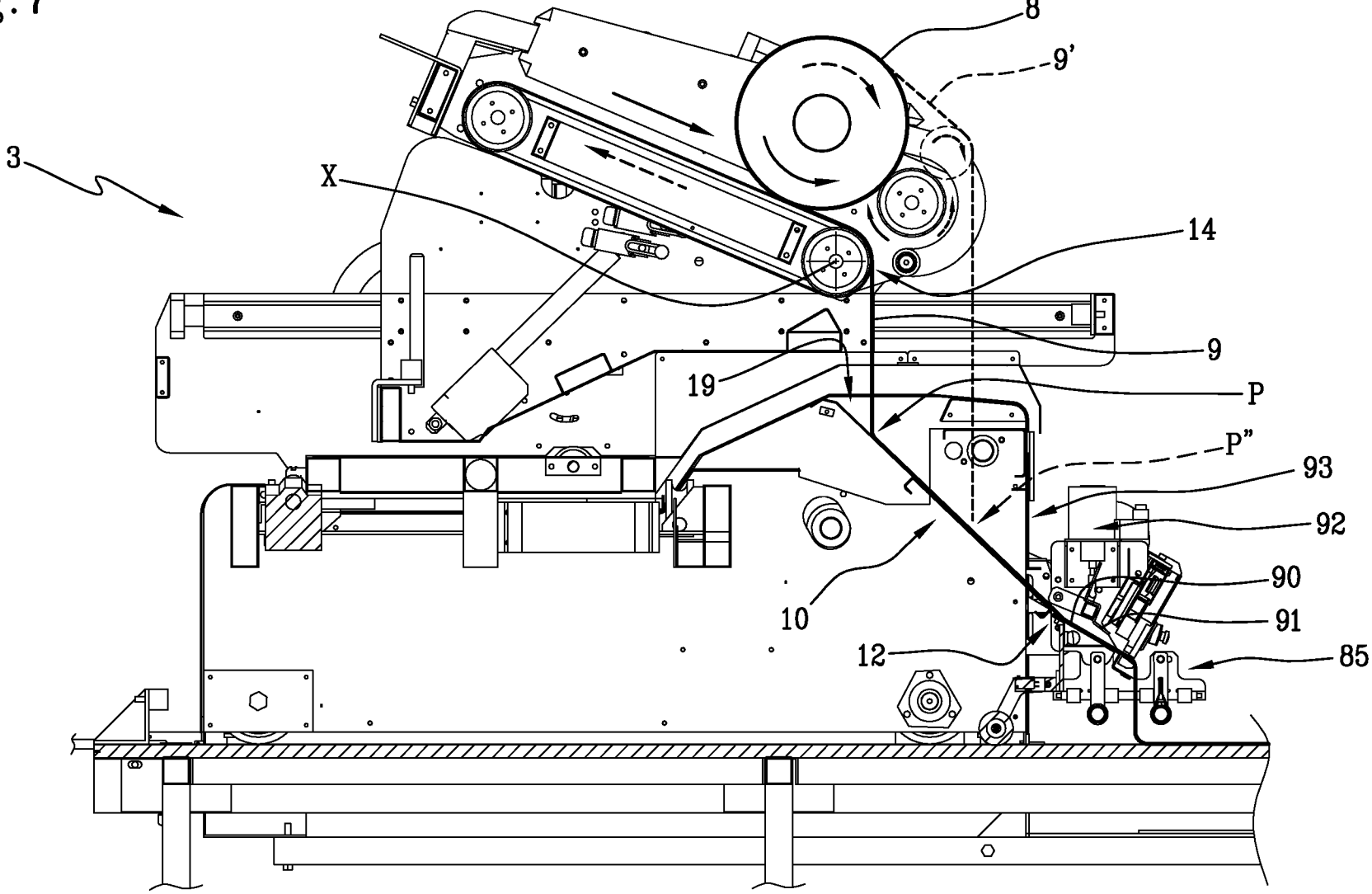
FIGS. 7-9 are partially-sectioned schematic views of some possible configurations of the machine in accordance with FIGS. 1-6.

Preferably, in a first configuration, shown by way of example in FIG. 7, the first end 14 of the unwinding system is vertical to the chute at a point P of the chute arranged in the vicinity of the upper end 19 of the chute (e.g. the distance on the plane of the chute from the upper end is about one tenth of the total length of the chute plane).

Figure 8:
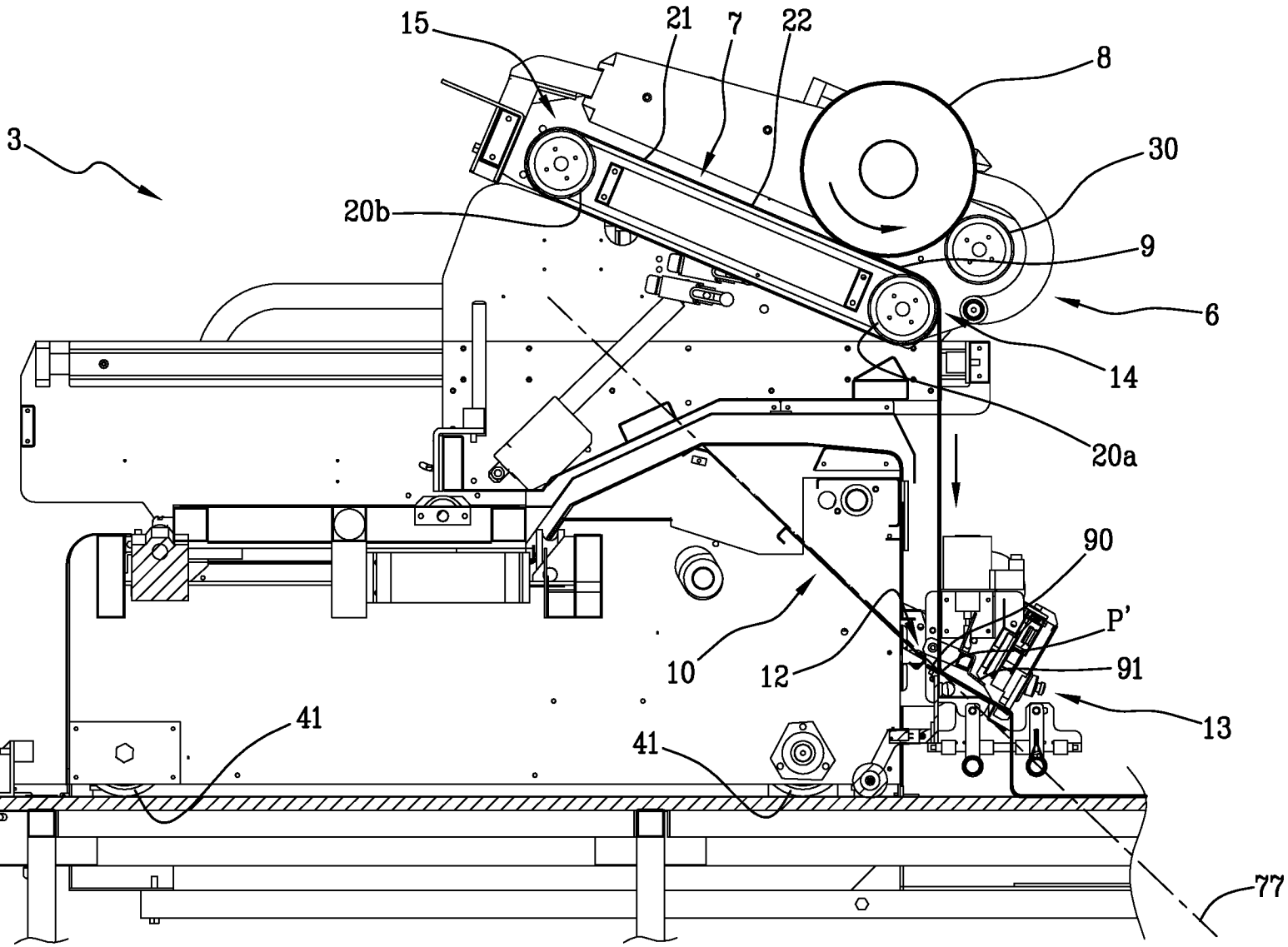

Preferably, in a second configuration, shown by way of example in FIG. 8, the first end 14 of the unwinding system is located on the vertical of a point P' in the vicinity of the cutting head upstream of the latter. Preferably, the point P' is located on the vertical of the auxiliary chute 90 of the cutting system, in the vicinity of an upper end thereof.

In an unillustrated embodiment, the cutting blade is oriented substantially horizontally (instead of vertically as in the illustrated examples) and the unwound fabric is dropped vertically from the first end to the spreading point, without the presence of any secondary chutes. In this case, in the second configuration, the first end of the unwinding system can be located on the vertical of a point beyond the cutting head, instead of before the latter as illustrated in FIGS. 8 and 11.

As revealed by a comparison of FIGS. 7 and 8, the distance, taken on the chute plane 77 along the direction of local advancement of the fabric, between the two respective points P, P' of vertical projection of the first end 14 on the chute plane in the first and the second configuration, respectively, is greater than half of the total length of the chute, for example equal to about the entire overall length.

As shown by way of example in FIGS. 7 and 8, in the first and second configuration, the conveying surface 22 is downhill from the second end 15 to the first end 14 of the conveying surface, forming an acute angle with the horizontal plane equal to 23° by way of example.

Figure 9:
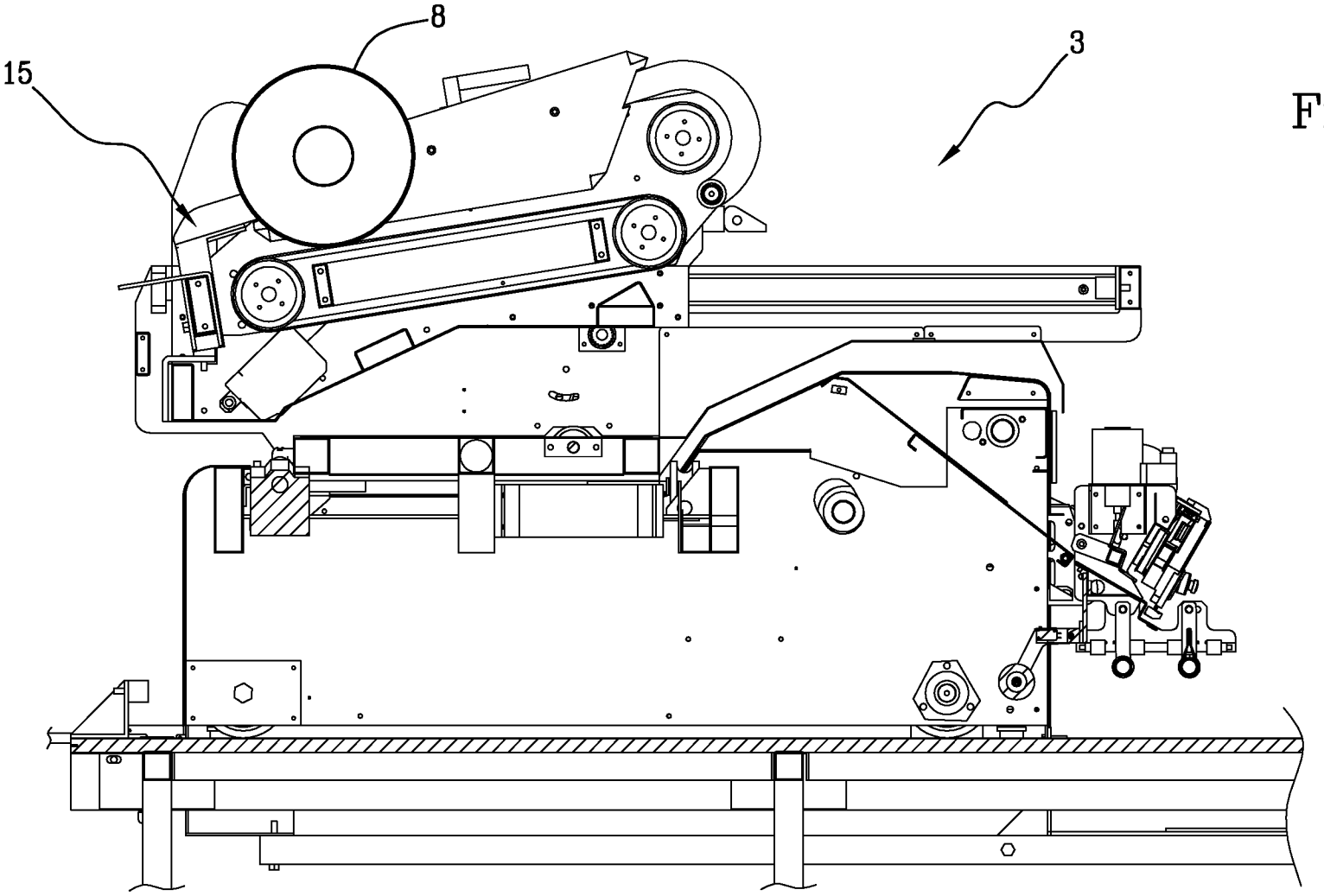

Preferably, in a loading/unloading configuration, as shown by way of example in FIG. 9, the second end 15 of the unwinding system is in a completely retracted position at one end side of the carriage opposite the cutting system, the conveying surface being substantially horizontal (forming for example an angle with the horizontal plane equal to 10°). In FIG. 9, the conveying surface is shown as slightly uphill, for example to facilitate the rolling movement of the roll 8, towards the left side of the figure, for unloading the roll. In an unillustrated variant of the loading/unloading configuration, the conveying surface can be slightly downhill or perfectly horizontal so as to facilitate loading of the roll and the rolling movement thereof towards the second roller.

In use, the operator interfaces with the command and control unit 100 and initially selects the loading position for example. Once the roll of fabric 8 has been loaded on the conveying surface 22, with the axis of the roll arranged parallel to the rotation axes of the rotation members, the operator selects the first configuration for example and the command and control unit configures the machine 1, including the unwinding system, in this configuration (FIG. 7). In particular, the command and control unit commands the movement system so that the unwinding system 6 (particularly the movable support 36) translates according to the first translational motion along a rectilinear, horizontal trajectory (arrow 45 in FIG. 2), from the completely retracted position (FIG. 9) to an advanced position (FIG. 7), and so that the unwinding system (particularly the rigid structure 37) rotates according to the second oscillatory motion (arrow 46 in FIG. 2) about the oscillation axis (FIG. 7).

In the first configuration, the second member cooperates with the first member so as to support and set the roll of fabric into rotation. By means of the simultaneous rotation (clockwise in the example shown in FIG. 7) of the first and second rotation members (with an identical or slightly different rotational speed so as to prevent creases of slack fabric from forming), the roll 8 undergoes rotation (counterclockwise in the example, as illustrated by the continuous arrow) so that a strip of the fabric 9 is unwound from the roll and conveyed only for a short end section of the conveying surface 22, until it drops vertically downwards once it has reached the first end of the first member, which in this case coincides with and realizes the first end 14 of the unwinding system. From there, the fabric drops vertically onto the point P of the chute and then slides on the latter until it reaches the lower end 12 and from there the auxiliary chute 90 of the cutting system. Once it has reached the lower end of the auxiliary chute, the strip of fabric drops downwards until it reaches the spreading plane. The forward-backward movement of the carriage 3 on the spreading plane, coordinated with the fabric unwinding speed, enables the strip of fabric to be spread on the spreading plane (possibly occupied by a stack of previously spread strips). Once the desired length of fabric has been laid out, the cutting head cuts the fabric transversely and the machine proceeds with the spreading process for the next strip.

The points described thus far referring to FIG. 7 regard the so-called normal unwinding process, wherein the strip of unwound fabric passes through the space between the first and the second roller, without touching the latter.

In the case in which the fabric needs to be spread on the opposite face with respect to the normal spreading process, the machine can be configured in a variant of the first configuration for the so-called "inverted" or "reversed" unwinding process. In this case, the rotational motion of the first and the second member and of the roll is the opposite of the motion in the normal unwinding process (as indicated by the broken lines in FIG. 7) and the strip of fabric (indicated by the broken line 9') is unwound from the upper portion of the roll, comes into contact with and is drawn by an additional roller (typically idle, illustrated schematically by a broken line in FIG. 7 and omitted in the other figures) in contact with the second member 30, and from there it drops vertically onto the chute 10. The description provided hereinabove holds from this point on. Note that while the strip of fabric is shown in FIG. 7 as dropping on the vertical of a point P" arranged further downstream of point P, in the variant of the first configuration for the inverted unwinding process, however, the unwinding system is typically slightly retracted (maintaining the inclination) with respect to the first configuration for the normal unwinding process, so that the strip of material drops onto a point that is adjustable according to the characteristics of the fabric, for example on the same point P (or in the vicinity thereof) as in the normal unwinding process (unillustrated variant).

When a fabric calls for the vertical drop spreading technique, the operator selects the second configuration (FIG. 8), wherein, in the normal unwinding process, the strip of fabric is unwound from the lower portion of the roll, passes through the space between the two members and drops vertically onto a point P' of the auxiliary chute 90 of the cutting system, completely avoiding the chute 10. The description provided hereinabove holds from this point on.

In the case of the inverted unwinding process (unillustrated), the operator selects a variant of the second configuration, wherein the above-mentioned additional roller arranged in contact with the second member 30 is located on the vertical of the point P'.

FIG. 10 shows that the embodiment of the machine that also comprises the third member 55 enables configuration of the machine also in a third configuration, in addition to the above-described first and second configurations and the loading/unloading configuration, with the variants thereof (and possibly with the articulation of the third member as described above); in this third configuration, the conveying surface is uphill from the second end to the first end of the conveying surface (e.g. forming an angle of 20° with the horizontal plane), and in which the first end of the unwinding system (coinciding with the first end of the conveying surface 22) is vertical to the point P of the chute, in a position similar to that assumed in the first configuration. In this manner, the third member cooperates with the first member so as to support and set the roll of fabric into rotation and the unwound fabric is conveyed along a substantial section of the conveying surface, as in the conventional unwinding technique.

FIG. 11 shows the machine of FIG. 10 in a fourth configuration, in which the conveying surface is uphill as in FIG. 10 and it is vertical to the point P' of the auxiliary chute, in a position similar to that assumed in the second configuration, so as to realize the vertical drop spreading process with the strip of fabric being conveyed on the conveying surface.

The invention claimed is:

1. A machine for spreading fabric on a spreading plane, comprising a carriage that is movable on the spreading plane with rectilinear forward-backward motion along a spreading direction, the carriage comprising:

an unwinding system comprising at least a first member adapted to set into rotation a roll of fabric so as to unwind the fabric;

an inclined chute arranged at a lower level of at least one portion of the first member, a cutting system for cutting the fabric, arranged at a lower end of the inclined chute and comprising a cutting head, wherein the unwinding system has a first end and a second end proximal to and distal from said cutting system, respectively, said first end being adapted, in use, to drop unwound fabric downwards, wherein said carriage comprises a movement system adapted to move said unwinding system between at least a first unwinding operating configuration and a second unwinding operating configuration, wherein the movement system comprises a movable support mounted on a base of the carriage and moveable relative to said base along a rectilinear trajectory parallel to said spreading direction, wherein said unwinding system is mounted onto said movable support, wherein, in said first unwinding operating configuration, said first end of the unwinding system is vertically over said inclined chute, and wherein said first end is located horizontally closer to said cutting head in the second unwinding operating configuration than in the first unwinding operating configuration.

2. The machine according to claim 1, wherein a distance, taken on a chute plane of said inclined chute along a direction of advancement of the fabric, between two respective points extending vertically of said first end on said chute plane, in said first and said second unwinding operating configuration, respectively, is greater than or equal to half of a total length of said inclined chute along said direction of advancement.

3. The machine according to claim 1, wherein in said first unwinding operating configuration, said first end of the unwinding system is vertically above a point of said inclined chute having a distance, from an upper end of said inclined chute, less than or equal to half of a total length of said inclined chute along a direction of advancement of the fabric along a chute plane, said distance being taken along said chute plane of said inclined chute, and wherein in said second unwinding operating configuration, said first end is vertically over a point on an auxiliary chute of said cutting system, wherein the auxiliary chute is placed proximate said cutting head upstream of the cutting head with respect to the direction of advancement of the fabric.

4. The machine according to claim 1, wherein said first member is a conveyor belt adapted to support said roll of fabric, and comprising a pair of motorized rollers and a mat arranged to wind the pair of motorized rollers so as to define a conveying surface of the unwinding system, the conveying surface having a direction of advancement for rotating the roll of fabric and/or for advancing the unwound fabric along said direction of advancement.

5. The machine according to claim 1, wherein the unwinding system comprises a second rotating member arranged in a vicinity of a first end of the first member, proximal to the first end of the unwinding system, and at least partially arranged in an upper half-space with respect to a conveying surface of the first member and separated from said first member, the second rotating member having a rotation axis parallel to a rotation axis of the first member and being motorized in an independent manner with respect to said first member, and wherein in said first and/or second unwinding operating configuration, the conveying surface descends from a second end of the conveying surface to a first end of the conveying surface, the conveying surface forming with a horizontal plane an acute angle that is less than or equal to 60°, and/or greater than or equal to 10°.

6. The machine according to claim 1, wherein the movement system is adapted to give to said unwinding system a first translational forward-backward motion with respect to said base of the carriage along said rectilinear trajectory, and a second oscillatory motion with respect to said base about an oscillation axis that is horizontal and substantially perpendicular to said spreading direction, the first translational forward-backward motion and/or second oscillatory motion being continuous.

7. The machine according to claim 6, wherein said first member of the unwinding system is rotatably mounted on a rigid structure, which is mounted on said movable support so as to oscillate according to said second oscillatory motion.

8. The machine according to claim 7, wherein the unwinding system comprises a first motor for powering in rotation said first member, a second rotating member and a second motor for powering in rotation said second rotating member, said oscillation axis extending along a rotation shaft of the first member powered by said first motor, and wherein the first motor is rigidly mounted on said movable support and the second motor is rigidly mounted on said rigid structure.

9. The machine according to claim 7, wherein the movement system comprises a third motor and first connection members between the third motor and said movable support, for giving said first translational forward-backward motion to the movable support, and wherein the movement system comprises a first actuation system that is operatively interposed between said movable support and said rigid structure, for giving said second oscillatory motion to the unwinding system.

10. The machine according to claim 1, wherein the movement system is adapted to move said unwinding system in a loading and/or unloading configuration, in which said first end of the unwinding system is more distal to the cutting head with respect to the first unwinding operating configuration, wherein a conveying surface of the unwinding system forms an angle, with a horizontal plane, having an absolute value less than or equal to 10°, and wherein the second end of the unwinding system is located at one end of the carriage opposite said cutting system.

11. The machine according to claim 10, comprising an electronic command and control unit operatively connected with said movement system, and configured and programmed to control said movement system in order to selectively configure the unwinding system in one of said first and second unwinding operating configurations, and in said loading and/or unloading configuration.

12. The machine according to claim 1, wherein the unwinding system comprises a third rotating member arranged in a vicinity of a second end of the first member, proximal to said second end of the unwinding system, and configured to assume at least a first position in which the third rotating member is at least partially arranged in an upper half-space with respect to a conveying surface, and wherein the movement system is adapted to move said unwinding system in a third configuration, in which the conveying surface of the unwinding system is uphill from the second end to the first end of the unwinding system, and wherein said first end of the unwinding system is vertical to said inclined chute.

13. The machine according to claim 1, wherein the cutting system is translatable with respect to a base of the carriage along a direction having at least one vertical component, and wherein the inclined chute comprises at least a first portion and a second portion that can reciprocally slide in a telescopic manner along a chute plane, the first portion of the inclined chute being fixed to the base and the second portion of the inclined chute being fixed to the cutting system.

14. The machine according to claim 1, wherein the cutting system comprises an auxiliary inclined chute arranged in proximity of the cutting head and upstream of the cutting head, surmounted on top by a retaining bar that is movable between a position in which the retaining bar is separated from the auxiliary chute and a contact position in which the retaining bar is pressed against the auxiliary chute, wherein the carriage comprises a screen arranged below at least one portion of the first member and above a lower end of said inclined chute, wherein the screen is made of a rigid material, wherein the screen has a substantially vertical extension, and wherein the screen comprises at least a first portion and a second portion that can reciprocally slide in a telescopic manner along an extension plane of the screen, the first portion of the screen being fixed to a base of the carriage and the second portion of the screen being fixed to the cutting system.

15. The machine according to claim 1, wherein the cutting system comprises a first detection system for detecting tension of the unwound fabric arranged downstream of the cutting head and below the cutting head, and wherein the cutting system comprises a second detection system for detecting a position of the fabric along a further direction parallel to the spreading plane and perpendicular to the spreading direction, said second detection system being active on a point arranged in the proximity of the cutting head upstream of the cutting head, and at an auxiliary inclined chute and/or near a lower end of the inclined chute.

16. A machine for spreading fabric on a spreading plane, comprising a carriage that is movable on the spreading plane with rectilinear forward-backward motion along a spreading direction, the carriage comprising:

an unwinding system comprising at least a first member adapted to set into rotation a roll of fabric so as to unwind the fabric;

an inclined chute arranged at a lower level of at least one portion of the first member;

a cutting system for cutting the fabric, arranged at a lower end of the inclined chute and comprising a cutting head;

wherein the unwinding system has a first end and a second end proximal to and distal from said cutting system, respectively, said first end being adapted, in use, to drop unwound fabric downwards;

wherein said carriage comprises a movement system adapted to move said unwinding system between at least a first unwinding operating configuration and a second unwinding operating configuration;

wherein, in said first unwinding operating configuration, said first end of the unwinding system is vertically over said inclined chute, and in said second unwinding operating configuration, said first end is located closer to a position vertically over said cutting head with respect to the first unwinding operating configuration; and wherein in said first unwinding operating configuration, said first end of the unwinding system is vertically above a point of said inclined chute having a distance, from an upper end of said inclined chute, less than or equal to half of a total length of said inclined chute along a direction of advancement of the fabric along a chute plane, said distance being taken along said chute plane of said inclined chute, and wherein in said second unwinding operating configuration, said first end is vertically over a point on an auxiliary chute of said cutting system, wherein the auxiliary chute is placed proximate said cutting head upstream of the cutting head with respect to the direction of advancement of the fabric.

17. A machine for spreading fabric on a spreading plane, comprising a carriage that is movable on the spreading plane with rectilinear forward-backward motion along a spreading direction, the carriage comprising:

an unwinding system comprising at least a first member adapted to set into rotation a roll of fabric so as to unwind the fabric;

an inclined chute arranged at a lower level of at least one portion of the first member;

a cutting system for cutting the fabric, arranged at a lower end of the inclined chute and comprising a cutting head;

wherein the unwinding system has a first end and a second end proximal to and distal from said cutting system, respectively, said first end being adapted, in use, to drop unwound fabric downwards;

wherein said carriage comprises a movement system adapted to move said unwinding system between at least a first unwinding operating configuration and a second unwinding operating configuration;

wherein, in said first unwinding operating configuration, said first end of the unwinding system is vertically over said inclined chute, and in said second unwinding operating configuration, said first end is located closer to a position vertically over said cutting head with respect to the first unwinding operating configuration; and wherein said first member is a conveyor belt adapted to support said roll of fabric, and comprising a pair of motorized rollers and a mat arranged to wind the pair of motorized rollers so as to define a conveying surface of the unwinding system, the conveying surface having a direction of advancement for rotating the roll of fabric and/or for advancing the unwound fabric along said direction of advancement.

* * * * *